US006502782B1

(12) United States Patent
Eugster

(10) Patent No.: US 6,502,782 B1
(45) Date of Patent: Jan. 7, 2003

(54) WINDING STAND FOR A REEL HUB EMPLOYED FOR WINDING AND UNWINDING FLAT PRINTED PRODUCTS

(75) Inventor: Albert Eugster, Strengelbach (CH)

(73) Assignee: Grapha-Holding AG, Hergiswil (CH)

( * ) Notice: Subject to any disclaimer, the term of this patent is extended or adjusted under 35 U.S.C. 154(b) by 751 days.

(21) Appl. No.: 08/636,937

(22) Filed: Apr. 24, 1996

(30) Foreign Application Priority Data

Apr. 24, 1995 (CH) ..... 01 177/95-9

(51) Int. Cl.[7] ..... B65H 39/14
(52) U.S. Cl. ..... 242/528; 242/399.1
(58) Field of Search ..... 242/528, 539, 242/533.8, 401, 406, 533, 559.4, 399.1

(56) References Cited

U.S. PATENT DOCUMENTS

| | | | | | |
|---|---|---|---|---|---|
| 1,836,815 | A | * | 12/1931 | Reeves | 242/399.1 |
| 4,532,750 | A | * | 8/1985 | Meier | 242/528 X |
| 4,679,743 | A | * | 7/1987 | Dallmaier | 242/559.4 X |
| 4,703,901 | A | * | 11/1987 | Stauber | 242/528 |
| 4,866,910 | A | * | 9/1989 | Reist | 242/528 X |
| 4,901,935 | A | * | 2/1990 | Reist | 242/528 X |
| 4,953,843 | A | * | 9/1990 | Reist | 242/528 X |
| 4,995,563 | A | * | 2/1991 | Kalin | 242/528 |
| 5,002,235 | A | * | 3/1991 | Greer et al. | 242/559.4 |
| 5,022,807 | A | | 6/1991 | Linder | |
| 5,176,333 | A | * | 1/1993 | Stauber | 242/528 |

FOREIGN PATENT DOCUMENTS

| | | |
|---|---|---|
| DE | 36 02 320 A1 | 8/1986 |
| EP | 0 149 058 A2 | 7/1985 |
| EP | 0 701 957 A1 | 3/1996 |

OTHER PUBLICATIONS

G. Miloscia, "Powered Cable Reel", Western Electric, p. 19, Jan. 1978.*

PrintRoll N–220 Marketing Brochure; "For maximum efficiency in the newspaper mailroom", Müller Martini AG Switzerland.

* cited by examiner

*Primary Examiner*—William A. Rivera
(74) *Attorney, Agent, or Firm*—Venable; Robert Kinberg

(57) ABSTRACT

For a space-saving and cost-effective device for winding or unwinding printed products onto or off of a reel hub (3), which can be supported on a winding stand and to which at least one winding tape (10) is supplied undershot to the reel hub (3) and which can be rolled off a winding mandrel to form wound layers of printed products, the drivable reel hub (3) is permanently joined on the front to an upper column part (4) of the winding stand, which roughly vertically penetrates the winding axis (8), and is removably supported on the winding stand element (5), which is composed of the winding stand foot (12) and the lower column part (13).

13 Claims, 1 Drawing Sheet

Figure 2:
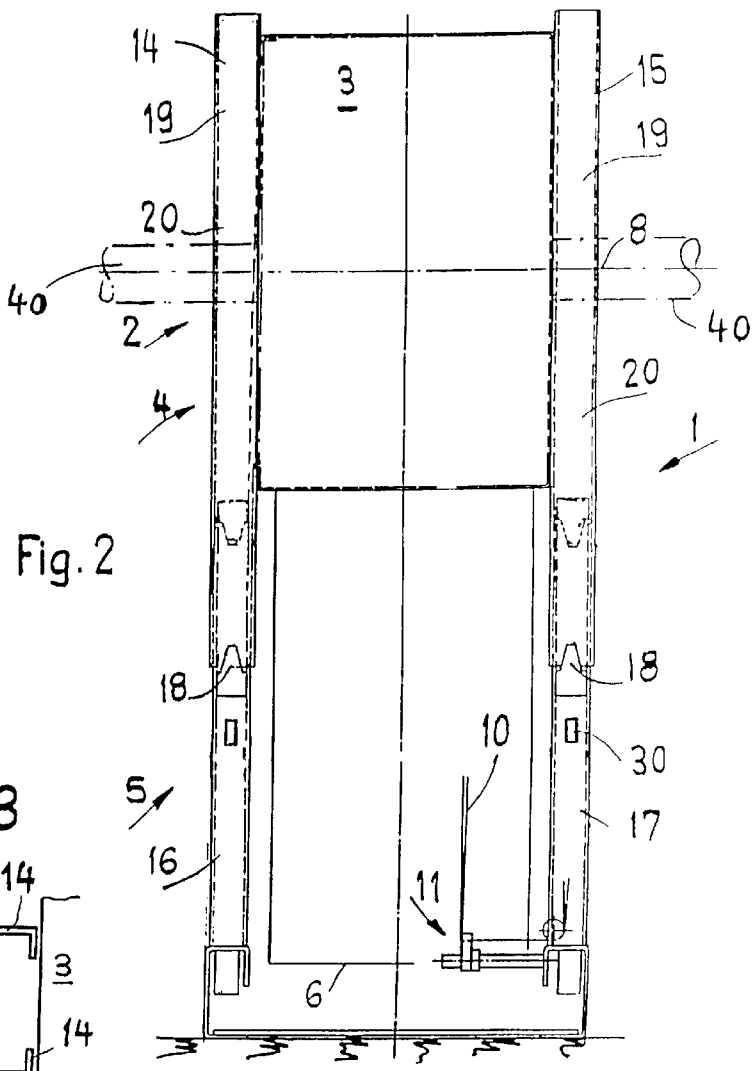

WINDING STAND FOR A REEL HUB EMPLOYED FOR WINDING AND UNWINDING FLAT PRINTED PRODUCTS

The invention relates to a device for winding and unwinding of mostly flat printed products onto or off of a reel hub which is located in a winding stand and to which is assigned at least one winding tape which is delivered undershot to the reel hub and which can be rolled off a winding mandrel to form wound layers of printed products.

In the print processing industry such devices are known under the name PrintRoll Systems by Mueller Martini. They are used to satisfy the demand for an economical processing after printing of the printed products or for higher production output after printing and are therefore used in production lines for gather-stitching, adhesive binding, thread stitching, and insertion; of course they can also be connected upstream or downstream of processing stations such as cutting machines, folding or addressing devices, stacking devices, etc.

In the PrintRoll System, a frame, the reel hub which can be driven therein, and the winding tape or the magazine of the winding tape form a unit which is inseparable with respect to use, which can be transported by a lifting means, and which can be used as a storage or feed means.

In addition, a similar principle is used for the same purpose, for which the reel or reel hub can be taken jointly with the winding tape from a frame, which holds the view that a unit as described above is burdened with higher procurement costs and requires a larger standing area.

A design as described briefly in the above for which the reel hub can be removed from the frame is also subject to disadvantages in application. Thus, among other things, a careful transportation and a corresponding storage of a reel—lying on the front—are not guaranteed; hence it follows that products damaged along the edges as a result of transportation or storage can lead to interruptions in the subsequent processing.

In addition, before winding or unwinding the printed products, the winding tape must be clamped on to the reel hub at one end respectively or to the winding mandrel of the tape magazine.

For a partial winding, the excess winding tape should be wound in the tape magazine before unwinding the printed products and conversely should be wound around the reel repeatedly after winding up the printed products.

The object of this invention is therefore to transfer certain advantages of the PrintRoll System to a device of the initially mentioned type which establishes an availability which carefully preserves the printed products during the transport and allows space-saving storage and favorable procurement costs.

The solution according to the invention is that the drivable reel hub and an upper column part of the winding stand that is permanently joined to it on the front and roughly perpendicularly penetrates the axis of rotation of the reel hub is detachably joined to the lower column part, which is connected to the foot of the winding stand.

Not only is it possible to retain the advantages of the PrintRoll System through this division of the winding stand, but the printed products can be easily wound and unwound without increased rotational forces.

It has proven especially favorable if the upper column part has attachment sections which have a varied length, distributed on the axis of rotation of the reel hub or the winding axis, which allow attachment, insertion or changing of the upper column part for producing reels with different diameters.

For this purpose, the attachment sections of the upper column part are designed so that they can be attached or inserted on the free ends on the lower column part of the winding stand, so that the reel or reel hub can be moved into the position of use within a short time.

The column parts are advantageously combined in their separation area, such that they form a common attachment or insertion section.

For purposes of a light but stable design, the upper and the lower column part are formed by two parallel supporting elements each, which are laterally spaced apart from one another.

It is advantageous if the supporting elements are formed with a hollow cross sectional profile to make use of a favorable moment of inertia.

The form-fitted connection of the supporting elements of the upper and lower column part can preferably be achieved with C-shaped transverse sections.

For the sake of simplicity, the supporting elements of the lower column part which accommodate the attachable or insertable supporting elements of the upper column part on their upper end each have at least one shoulder-like support which allows reliable mounting of the reel in the winding stand.

Of course, this support could also be provided on the supporting elements of the upper column part.

The support on the supporting elements could be made to project both to the inside and the outside.

Figure 1:
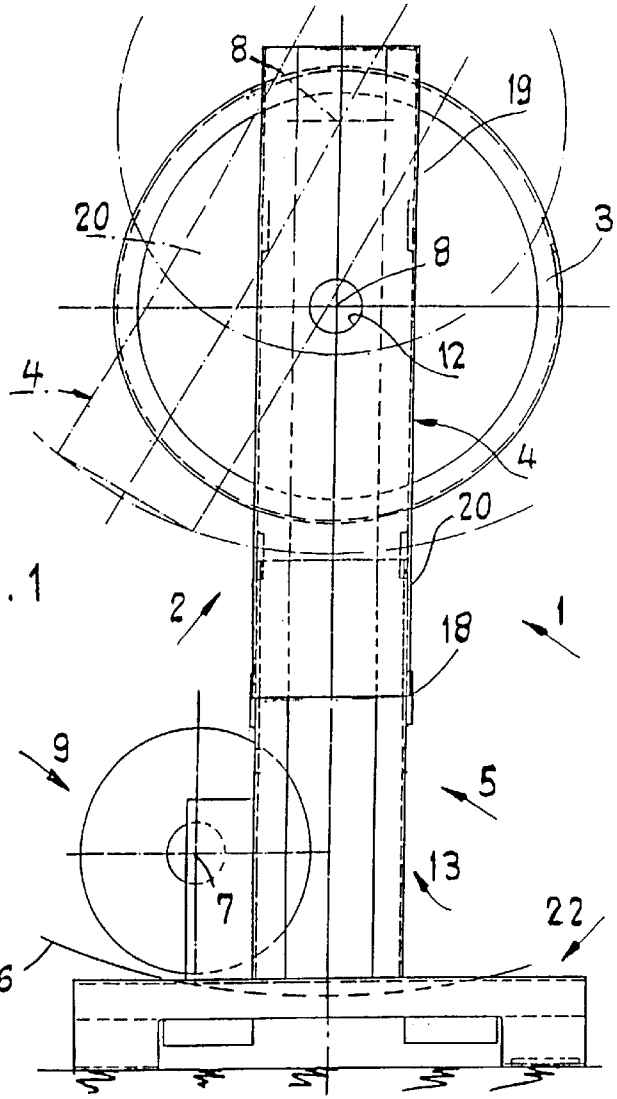

The invention is explained with the aid of an embodiment and with regard to the drawing, to which reference is made with respect to all details not further mentioned in the description. The drawing shows in:

FIG. 1 A side view of the device according to the invention and

FIG. 2 A section through the device according to line II—II in FIG. 1.

Figure 3:
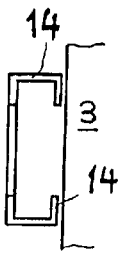

FIG. 3 shows a support element in FIG. 2 in a view from above.

In order to wind and unwind printed sheets for the device 1 shown in FIGS. 1 and 2, the upper winding stand element 2 consisting of a reel hub 3 for the printed products rolled in layers and an upper column part 4, which is welded or permanently joined to it, is removed by means of a lifting means from the lower winding stand element 5 and is placed in a frame which is suitable for winding or unwinding (not shown). In this case, the upper winding stand element 2 is supported to turn freely in this frame and is driven rotatably by means of a tangential drive on the periphery of the reel hub 2 [sic] or the reel 6.

Instead of the tangential drive which is not shown, a central drive which acts upon the rotary axis of reel hub 3 could also be used, wherein the number of revolutions could be controlled depending on the changing reel diameter for a constant peripheral speed.

Of course, the frame which accommodates the upper winding stand element 2 could be designed with a lifting device, which lifts upper winding stand element 2 from the lower one into a drivable position. Such a device is disclosed among others in CH Patent Application No. 2795/94.

The lower winding stand element 5 has at least one tape magazine 9 for accommodating a winding tape 10 which can be rolled around an axis 7, located parallel to winding axis 8, and which runs roughly tangentially and undershot onto reel hub 3 or reel 6 for its use. For this, an erectable band guide 11 is required between the tape magazine and reel, which is not discussed here. In FIG. 2, the tape guide 11 is indicated in sections.

The reel hub 3 is supplied and unloaded conventionally by adaptable conveyor belts, which are not shown in the drawing.

FIGS. 1 and 2 furthermore show a secure connection of the ring-shaped reel hub 3 with the upper column part 4 which perpendicularly penetrates the rotary axis or winding axis 8 of the reel hub 3 and simultaneously holds the positioning of the upper winding stand element 2. For the positioning of the upper winding stand element 2 in column part 4, a borehole 12 is provided on each side of the reel hub 3, into which for example a journal of the frame provided for winding and/or unwinding is inserted.

Conversely, the boreholes could also be provided on the frame and the journals could also be attached so as to project outward from the reel hub.

The lower winding stand element 5 has a winding stand foot 12 in the form of a welded structure to which lower column part 13 is attached (welded) projecting at roughly a right angle.

The winding stand elements 2 and 5 are assembled one on top of the other by vertically pushing the lower column part 13 into the upper column part 2 [sic] or vice versa, such that in the separating area of winding elements 2, 5 a common attachment or insertion section is formed. The embodiment of column parts 4, 13 has respectively two supporting elements 14, 15 and 16, 17 that are arranged parallel to each other, at the distance of reel hub 3. The supporting elements are provided with an at least partially hollow cross section, wherein the supporting elements 14 through 17 of the version shown are C-shaped and the supporting elements 14, 15 assigned to upper column part 4 have the correspondingly larger cross section, so that they encompass the supporting elements 16, 17 of the inserted lower column part in a form-fitting way. Another open or a closed cross sectional profile for supporting elements 14 through 17 could also be selected which ensures a relatively narrow insert guide. The required stability of winding stand elements 2, 5 can be achieved, as shown, with a wedge-shaped arrangement, in that the upper column part 4 is supported on the one hand centrally and on the other is suspended from the free ends of supporting elements 14, 15, on shoulder- or saddle-shaped supports of the lower column part 13. It is possible to do this on the insides as well as the outsides of supporting elements 14 through 17.

In the drawing, especially in FIG. 1, the attachment sections 19, 20 of the upper column part 4 which are of varied length are shown. That is, reel diameters of varied size can be produced in this way, if the free end of shorter attachment section 19 or the free end of longer attachment section 20 of the upper column part 4 is optionally combined with lower column part 13. This possibility allows an optimum use of a storage or transport space of a motor vehicle.

The dash-dot line in FIG. 1 furthermore shows the minimum dislocation height for the rotary or winding axis when the upper winding stand element 2 is removed from the lower element 5.

To transport the device, recesses 30 are provided on lower column part 13 by which the device can be held, for example by a stacker.

The upper column part 4 can be raised from the lower part 13 by just such a transporting device 30 on the former.

The winding tape can be positioned and tensioned in the operating as well as in the resting position of the device by known methods.

What is claimed is:

1. In a device for winding and unwinding primarily flat printed products onto or off of a drivable reel hub located in a winding stand and being assigned at least one wound belt delivered undershot to the reel hub from a winding mandrel to form wound layers of printed products on the reel hub, the improvement wherein:

the winding stand comprises a foot, a lower column part connected to the foot, and an upper column part detachably joined to the lower column part; and the reel hub is permanently joined to the upper column part and has an axis of rotation that extends roughly perpendicular to the upper column part.

2. The device according to claim 1, wherein the upper column part includes two attachment sections of different lengths.

3. The device according to claim 2, wherein the attachment sections each have a free end adapted to be joined to the lower column part of the winding stand.

4. The device according to claim 3, wherein the lower and upper column parts have a common attachment section in a region of separation between the lower and upper column parts.

5. The device according to claim 4, wherein the lower and upper column parts each comprise spaced apart, parallel support elements.

6. The device according to claim 5, wherein the support elements each have a hollow cross section.

7. The device according to claim 6, wherein the cross section is C-shaped.

8. The device according to claim 7, wherein the support elements of the lower column part each have an upper region including a centering rest for centering a respective support element of the upper column part.

9. The device according to claim 8, wherein the rests are arranged to project one of inwardly and outwardly on the support elements of the lower column part.

10. The device according to claim 9, wherein the support elements of the lower column part are attached substantially vertically to the winding stand foot.

11. The device according to claim 10, the lower column part includes means for supporting the wound belt.

12. The device according to claim 11, wherein the upper column part and the reel hub joined thereto constitute an upper winding stand element which is adapted to be separate from the lower column part when printed products are wound or unwound and combined with the lower column part during transport or storage.

13. The device according to claim 1, wherein the lower column part includes a transport device.

* * * * *